US008310435B2

(12) United States Patent
Kang et al.

(10) Patent No.: US 8,310,435 B2
(45) Date of Patent: Nov. 13, 2012

(54) LIQUID CRYSTAL DISPLAY DEVICE CAPABLE OF AUTOMATICALLY SWITCHING TO A MODE AND METHOD FOR DRIVING THE SAME

(75) Inventors: Hee Kwang Kang, Seoul (KR); Kyo Seop Choo, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 1004 days.

(21) Appl. No.: 11/638,387

(22) Filed: Dec. 14, 2006

(65) Prior Publication Data

US 2007/0152952 A1 Jul. 5, 2007

(30) Foreign Application Priority Data

Dec. 30, 2005 (KR) ..... 10-2005-0135922

(51) Int. Cl.
*G09G 3/36* (2006.01)
*G09G 5/00* (2006.01)

(52) U.S. Cl. ..... 345/102; 345/207

(58) Field of Classification Search ..... 345/207, 345/87–102; 348/602
See application file for complete search history.

(56) References Cited

U.S. PATENT DOCUMENTS

| | | | | |
|---|---|---|---|---|
| 7,068,333 | B2 * | 6/2006 | Ohashi et al. | 349/68 |
| 7,218,048 | B2 * | 5/2007 | Choi et al. | 313/504 |
| 7,301,523 | B2 * | 11/2007 | Kamei | 345/102 |
| 7,505,025 | B2 * | 3/2009 | Edelbrock | 345/102 |
| 2002/0030660 | A1 * | 3/2002 | Arakawa | 345/102 |
| 2003/0231161 | A1 * | 12/2003 | Yamaguchi | 345/102 |
| 2005/0082968 | A1 * | 4/2005 | Choi et al. | 313/506 |
| 2005/0110742 | A1 * | 5/2005 | Arakawa | 345/102 |
| 2005/0117079 | A1 * | 6/2005 | Pak et al. | 349/43 |
| 2005/0156867 | A1 * | 7/2005 | Edelbrock | 345/102 |
| 2005/0231457 | A1 * | 10/2005 | Yamamoto et al. | 345/102 |
| 2005/0275616 | A1 * | 12/2005 | Park et al. | 345/102 |
| 2006/0262055 | A1 * | 11/2006 | Takahara | 345/81 |
| 2007/0046619 | A1 * | 3/2007 | Sano et al. | 345/102 |
| 2007/0153157 | A1 * | 7/2007 | Kang et al. | 349/61 |
| 2007/0268241 | A1 * | 11/2007 | Nitta et al. | 345/102 |

FOREIGN PATENT DOCUMENTS

| | | | |
|---|---|---|---|
| JP | 63141378 | A * | 6/1988 |
| JP | 2002-174806 | | 6/2002 |
| JP | 2004-078160 | | 3/2004 |
| KR | 10-2005-0117464 | | 12/2005 |

* cited by examiner

*Primary Examiner* — Sumati Lefkowitz
*Assistant Examiner* — Rodney Amadiz
(74) *Attorney, Agent, or Firm* — McKenna Long & Aldridge, LLP

(57) ABSTRACT

A liquid crystal display device includes a liquid crystal display panel including a first substrate having a display region and a non-display region, a liquid crystal layer, and a second substrate; a backlight unit opposite a surface of the first substrate that illuminates light onto the liquid crystal display panel; a plurality of gate lines arranged to cross a plurality of data lines on the first substrate; a plurality of first and second sensor lines substantially parallel to the data lines; a plurality of first sensors at crossings of the gate lines and the first sensor lines in a first region of the first substrate to sense ambient light; and a plurality of second sensors at crossings of the gate lines and the second sensor lines in a second region of the first substrate to sense light from the backlight unit.

14 Claims, 7 Drawing Sheets

LIQUID CRYSTAL DISPLAY DEVICE CAPABLE OF AUTOMATICALLY SWITCHING TO A MODE AND METHOD FOR DRIVING THE SAME

This application claims the benefit of Korea Patent Application No. 10-2005-135922, filed on Dec. 30, 2005, which is hereby incorporated by reference for all purposes as if fully set forth herein.

BACKGROUND OF THE INVENTION

1. Field of the Invention

The present invention relates to a liquid crystal display (LCD) device, and more particularly, to an LCD device capable of automatically switching to a transmission mode or a reflection mode and a method for driving the same.

2. Discussion of the Related Art

The cathode ray tube (CRT) is a widely used as a display device. While cathode ray tube based displays are commonly used as the monitors for information terminal apparatuses, because of their size and weight, CRT based displays not particularly well suited to address the current trends for miniaturization and lightweight trends for electronic products.

Liquid crystal display (LCD) device based displays have advantages of light weight, low power consumption, and slim profile over CRT displays. In particular, displays employing LCD devices using thin film transistors (TFTs) having high image quality, large sizes, and color display capability nearly equal to those of a CRT are widely used in a variety of applications including monitors and the displays of notebook personal computers (PCs).

The LCD device is a transmissive display device and controls an amount of light passing through a liquid crystal (LC) layer using anisotropy in a refractive index of LC molecules contained in the LC layer to display a desired image on a screen. A typical LCD device includes a backlight unit to provide light for transmitting through the LC layer in order to display pixels of an image. Such a LCD device can be roughly divided into an LC display panel and a backlight unit provided at the rear of the LC display panel.

The LC display panel is the portion of an LCD device on which the image is realized and includes a lower substrate, an upper substrate, and an LC layer interposed between the two substrates. The lower substrate includes a driving device such as a TFT and a pixel electrode. The upper substrate includes a color filter layer and a common electrode. A driving circuit unit is provided on a lateral side of the lower substrate to apply signals to the TFT, the pixel electrode, and the common electrode formed on the lower substrate.

The backlight unit includes a light source for emitting light, a reflector for reflecting light generated from the light source to improve a light efficiency, and optical sheets for diffusing and condensing the light.

LCD devices can be roughly classified into transmission type LCD devices displaying an image using light incident from a backlight unit and reflection type LCD devices displaying an image by reflecting external light such as natural light. The transmission type LCD device has that disadvantage that power consumption of the backlight unit is large. Meanwhile, the reflection type LCD device has the disadvantage that an image cannot be displayed in dark environments because the reflection type LCD device depends on ambient light to display images.

To address these disadvantages, a transflective LCD device has been developed that can selectively operate in either a transmission mode using a backlight unit or in a reflection mode using external light or ambient. Because the transflective LCD device operates in a reflection mode when ambient light is sufficient and operates in a transmission mode using a backlight unit when the ambient light is not sufficient, the transflective LCD device can have reduced power consumption compared to the transmission type LCD device and are not limited by ambient light conditions as is the reflection type LCD device.

In a related art transflective LCD device, a user judges the amount of ambient light and selects a reflection mode or a transmission mode. Therefore, the transflective LCD device may operate in the reflection mode when the amount of ambient light is not sufficient and may operate in the transmission mode when the amount of ambient light is sufficient. In the transflective LCD device in which the mode is selected by a user, the user may not accurately judge the amount of external light and light from the backlight unit. Accordingly the user may select the reflection mode even when the amount of ambient is not sufficient for proper viewing of the display, or may select the transmission mode even though there is a sufficient amount of ambient external light is sufficient for producing a quality display without reducing the display quality of the transflective LCD device.

SUMMARY OF THE INVENTION

Accordingly, the present invention is directed to liquid crystal display device and a method for driving the same that substantially obviate one or more problems due to limitations and disadvantages of the related art.

An advantage of the present invention is to provide a liquid crystal display device and a method for driving the same that using a plurality of first light sensors sensing external light and a plurality of second light sensors sensing light from a backlight unit to control the operation of the backlight unit Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a liquid crystal display panel including: a liquid crystal display panel including a first substrate having a display region and a non-display region, a liquid crystal layer, and a second substrate; a backlight unit opposite a surface of the first substrate that illuminates light onto the liquid crystal display panel; a plurality of gate lines arranged to cross a plurality of data lines on the first substrate; a plurality of first and second sensor lines substantially parallel to the data lines; a plurality of first sensors at crossings of the gate lines and the first sensor lines in a first region of the first substrate to sense ambient light; and a plurality of second sensors at crossings of the gate lines and the second sensor lines in a second region of the first substrate to sense light from the backlight unit.

In another aspect of the present invention, a method for driving a liquid crystal display device includes: a liquid crystal display panel including: a first substrate and a second substrate; a backlight unit opposite a surface of the first substrate that illuminates light; a plurality of gate lines and data lines arranged to intersect on the first substrate; a plurality of first and second sensor lines arranged in parallel to the data lines; a plurality of first sensors on crossings of the gate lines and the first sensor lines in a first region of the first substrate; a plurality of second sensors on crossings of the gate lines and the second sensor lines in a second region of the first substrate; a comparing unit connected to the first and second sensor lines; and a control unit connected between the comparing unit and the backlight unit including: sensing ambient light using the first sensors; sensing light from the backlight unit using the second sensors; and comparing an intensity of ambient light with an intensity of light from the backlight unit to control the backlight unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to the embodiments of the present invention, examples of which are illustrated in the accompanying drawings.

Figure 1:
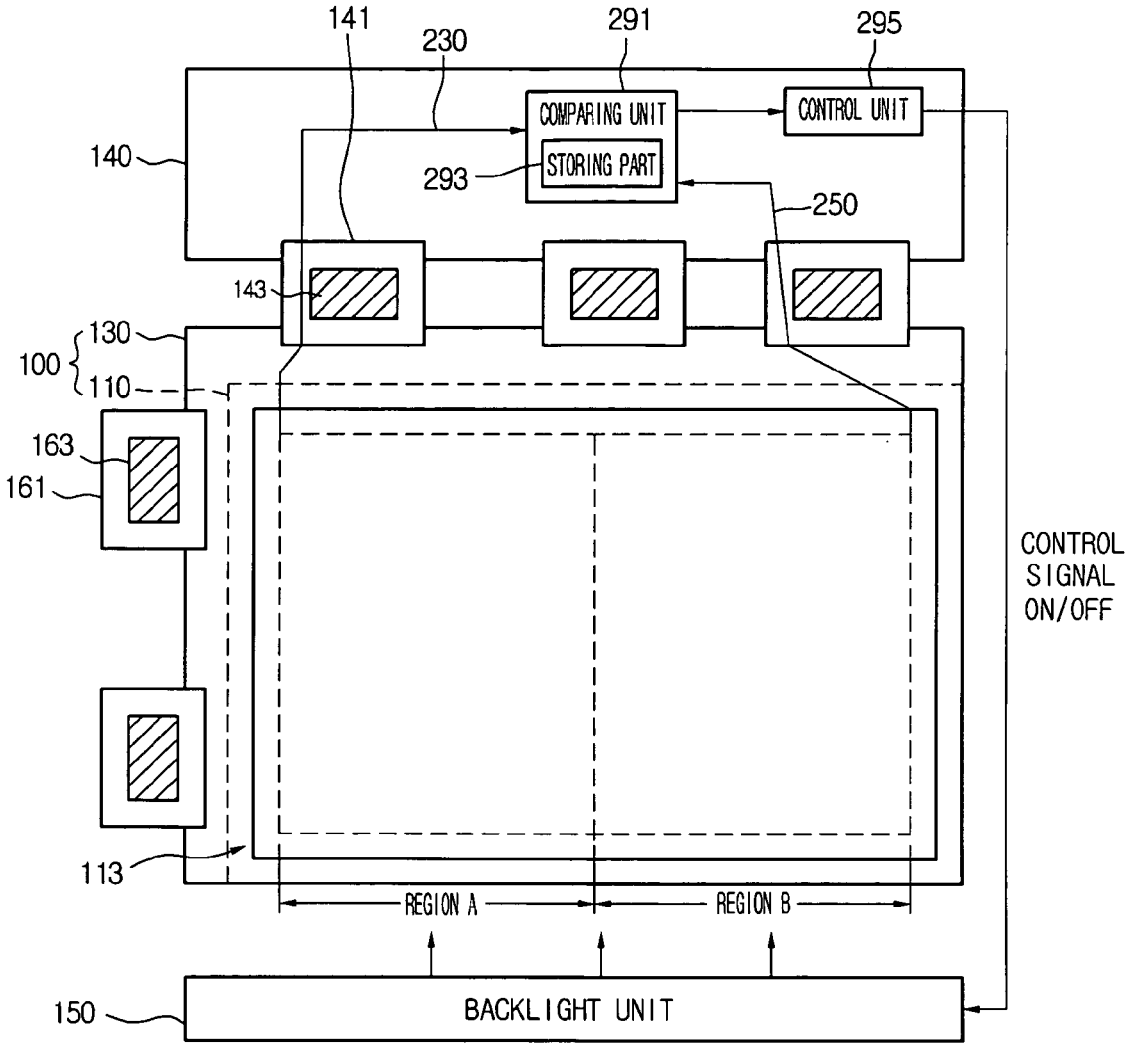
FIG. 1 is a view of a liquid crystal display device according to an embodiment of the present invention.

FIG. 1 is a view of a liquid crystal display device according to the present invention.

Figure 2:
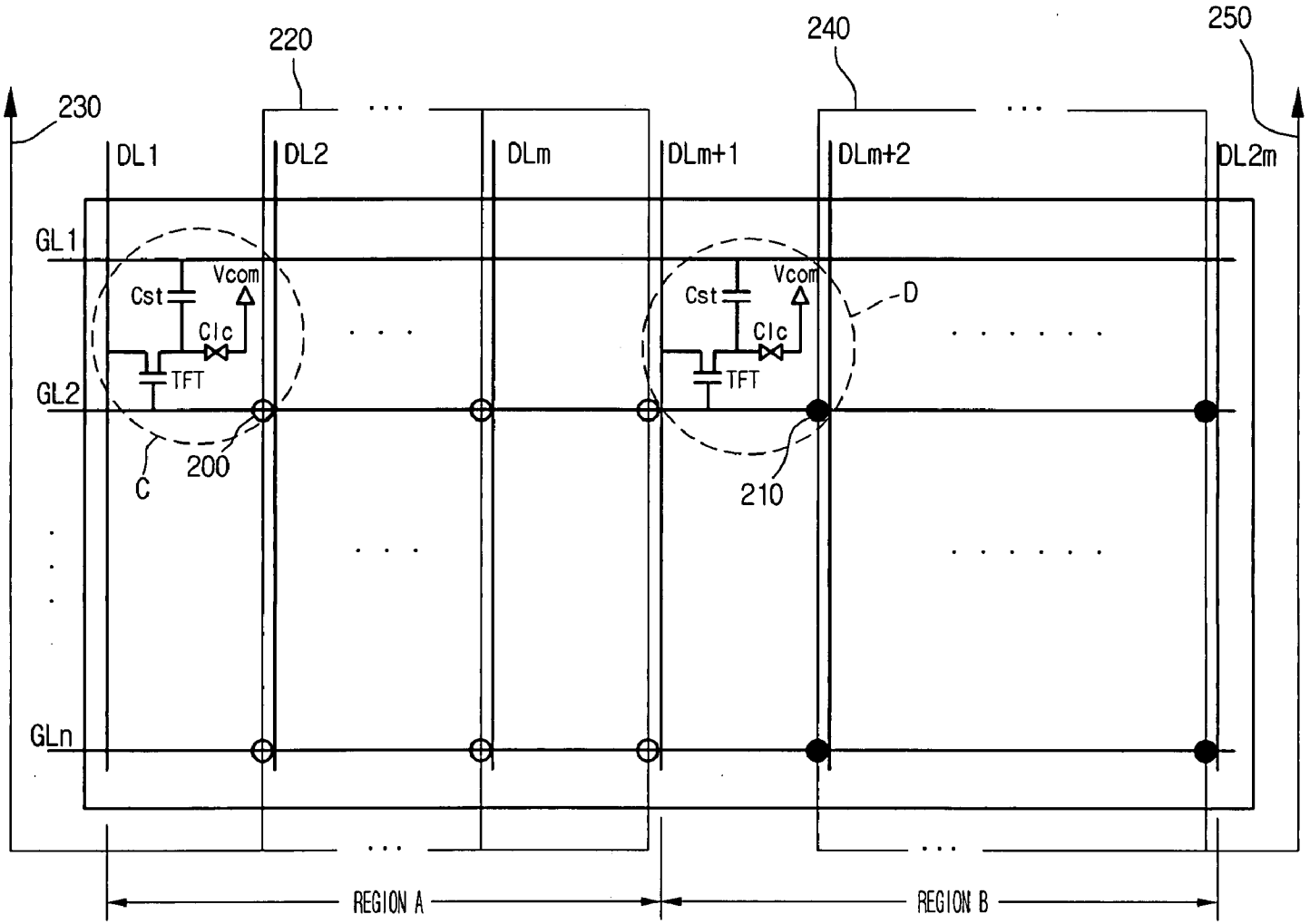
FIG. 2 is a view of a liquid crystal panel according to an embodiment of the present invention.

Referring to FIGS. 1 and 2, the liquid crystal display (LCD) device includes an liquid crystal (LC) display panel 100, a plurality of data tape-carrier packages (TCPs) 141 connected between the LC display panel 100 and a data printed circuit board (PCB) 140, a plurality of gate TCPs connected on one side of the LC display panel 100, data driver integrated circuits (ICs) 143 mounted on the data TCPs 141, respectively, gate driver ICs 163 mounted on gate TCPs 161, respectively, and a backlight unit 150 for providing light onto the LC display panel 100.

The LC display panel 100 includes a lower substrate 130 and an upper substrate 110 each formed of a transparent insulating substrate and a LC layer interposed between the lower substrate 130 and the upper substrate 110.

The upper substrate 110 is a color filter substrate. Though not shown in detail, color filters of R, G, and B for realizing colors are formed in pixel regions of the upper substrate 110 and a black matrix (BM) 113 for preventing light leakage is formed in a BM region of the upper substrate 110. The BM 113 is formed in boundary regions between pixels to prevent light leakage between the pixels. The color filter 111 may be a resin layer including dye or pigment. An overcoat layer for planarizing the color filter 111 may be formed on the color filter 111. A common electrode is formed on the overcoat layer to apply a voltage onto the LC layer.

A plurality of gate lines, GL1-GLn and data lines DL1-DL2*m* are arranged to cross perpendicularly on the lower substrate 130. A first sensor line 220 and a second sensor line 240 are spaced a predetermined distance from and formed in parallel to the data lines DL1-DL2*m*. Pixel regions are defined by crossings of the gate lines GL1-GLn and the data lines DL1-DL2*m*.

The lower substrate 130 is divided into a region A and a region B.

The first sensor line 220 is formed in the region A and the second sensor line 240 is formed in the region B.

Switching devices for switching pixels are formed at crossing portions of the gate lines GL1-GLn and the data lines DL1-DL2*m*. A first light sensor 200 or a second light sensor 210 for sensing light is formed on crossing portions of the gate lines GL1-GLn and the first and second sensor lines 220 and 240 respectively. Also, the first and second light sensors 200 and 210 are formed near a pixel region unit.

Each of the switching devices and the first and second light sensors 200 and 210 are formed of a thin film transistor (TFT). The TFTs each include a gate electrode, a semiconductor layer, and source and drain electrodes. Though not shown in detail, a gate pad and a data pad for applying signals are formed on one side of the gate lines GL1-GLn and the data lines DL1-DL2*m*, respectively. A pixel electrode, which is an electrode corresponding to the common electrode, is formed in each pixel. A reflective electrode for reflecting external light is formed on the pixel electrode. The common electrode and the pixel electrode are formed of a transparent conductive material such as indium tin oxide (ITO) and indium zinc oxide (IZO).

The first sensor line 220 is formed in a region A of the LC display panel 100 and the second sensor line 240 is formed in a region B of the LC display panel 100.

The first light sensor 200 located in region A in which the first sensor line 220 is formed senses external light (light external to the LCD device) and the second light sensor 210 located in region B in which the second sensor line 240 is formed senses light from the backlight unit 150.

The first and second sensor lines 220 and 240 may be formed simultaneously with the forming of the data lines DL1-DL2*m* without using an additional, separate process.

The first and second light sensors 200 and 210 may be formed simultaneously with the forming of the switching device of the pixels.

One of the first and second light sensors 200 and 210 may be formed in each pixel. Therefore, the first and second light sensors 200 and 210 may be uniformly distributed over an entire surface of the LC display panel 100 to more accurately sense the external light and the light from the backlight unit 150.

The first sensor line 220 connected to the plurality of first light sensors 200 is connected to a first sensor output line 230 and the second sensor line 240 connected to the plurality of second light sensors 210 is connected to a second sensor output line 250.

The first and second sensor output lines 230 and 250 are electrically connected to a comparing unit 291 via the data TCP 141.

The comparing unit 291 compares an output voltage from the first light sensors 200 with an output voltage from the second light sensors 210.

The comparing unit 291 is connected to the control unit 295 controlling an operation of the backlight unit 150.

When an output voltage applied from the first light sensor 200 is smaller than an output voltage applied from the second light sensor 210, the comparing unit 291 applies an ON-control signal to the backlight unit 150 using the control unit 295. On the other hand, when an output voltage applied from the first light sensor 200 is greater than an output voltage applied from the second light sensor 210, the comparing unit 291 applies an OFF-control signal to the backlight unit 150 using the control unit 295.

The backlight unit 150 turns on a light source thereof to emit light in response to an ON-control signal applied from the control unit 295 thus initiating or maintaining an operation of the backlight unit 150 and turns off the light source, suspending the operation of the backlight unit so that it does not emit light in response to an OFF-control signal applied from the control unit 295.

Because the second light sensor 210 does not sense light when the light source of the backlight unit 150 is turned off, the comparing unit 291 may further include a storing part 293 for storing a last input voltage applied from the second light sensor 210 before the light source of the backlight unit 150 is turned off.

The storing part 293 provides an input voltage for comparison with an input voltage of the first light sensor 200 when the light source of the backlight unit 150 is turned off.

The transflective LCD device includes a plurality of first light sensors 200 sensing external light and a plurality of second light sensors 210 sensing the light from the backlight unit 150, the first and second light sensors 200 and 210 formed when forming switching devices (e.g., TFTs) of the lower substrate 130. In the transflective LCD device according to an embodiment of the present invention, the intensity of external light illuminated onto a front side of the LC display panel 100 is compared with the intensity of light from the backlight unit 150 to automatically control the backlight unit 150 allowing power consumption to be reduced without a deterioration of display quality.

Figure 3A:
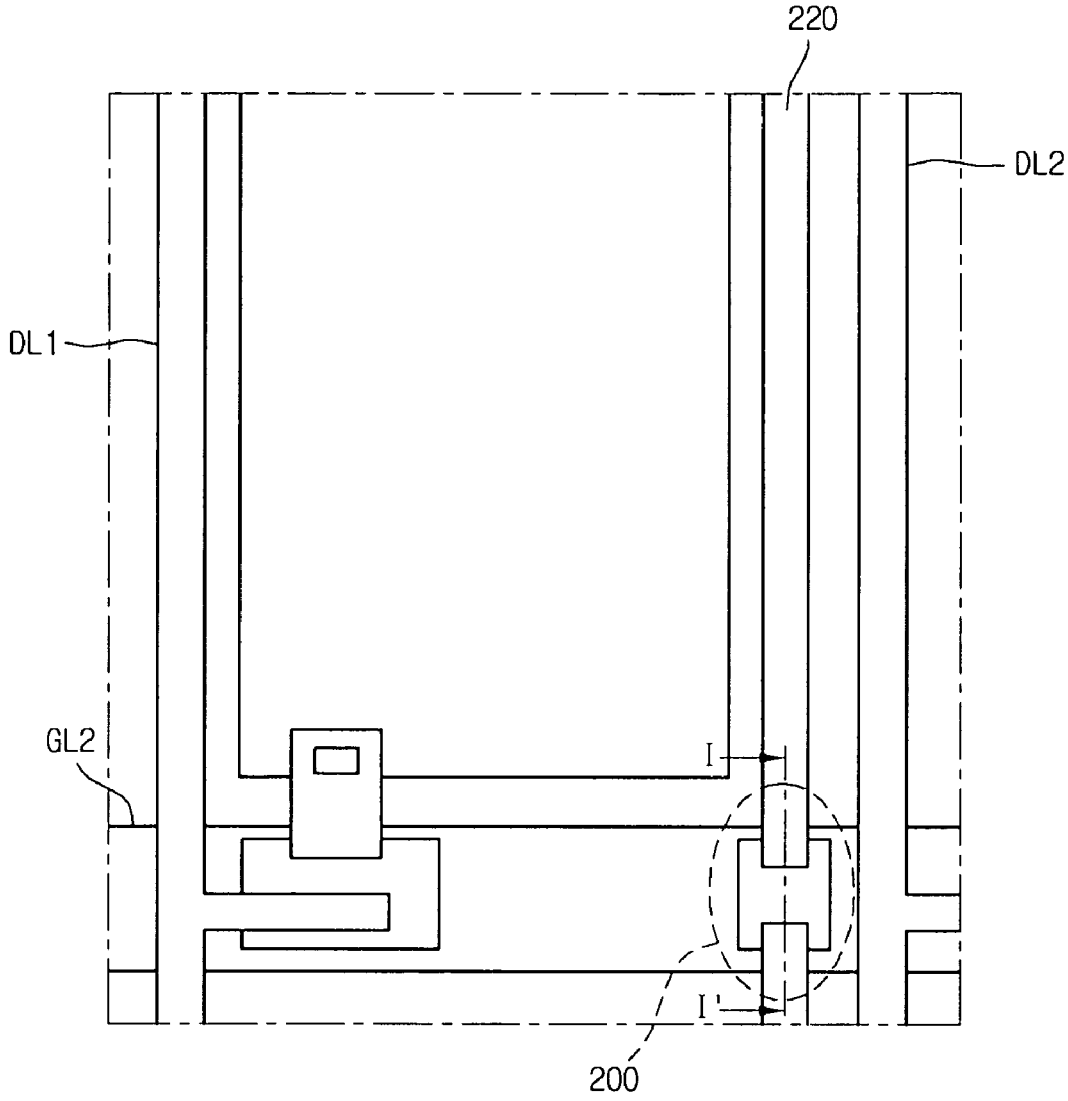
FIG. 3A is a detailed view illustrating a portion C of FIG. 2.
Figure 3B:
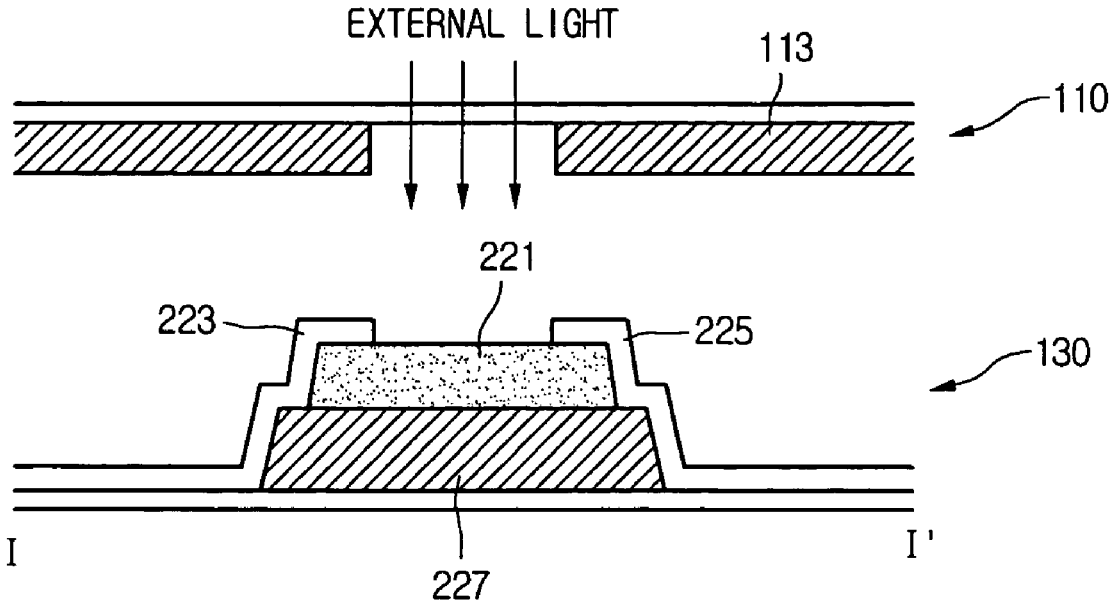
FIG. 3B is a cross-sectional view taken along a line I-I' of FIG. 3A.

FIG. 3A is a detailed view illustrating a portion C of FIG. 2 and FIG. 3B is a cross-sectional view taken along a line I-I' of FIG. 3A.

Referring to FIGS. 3A and 3B, the first light sensor 200 is formed in a region where the gate line GL2 and the first sensor line 220 spaced apart from the data line DL1 by a predetermined distance from and parallel to the data line DL1 on the lower substrate 130 cross.

The first light sensor 200 includes a first gate electrode 227, a first semiconductor layer 221, and first source and drain electrodes 223 and 225. The first light sensor 200 may be able to be formed on the gate line GL2. The first gate electrode 227 is the gate line GL2 at this time.

The first light sensor 200 may be formed simultaneously with the forming of the switching devices (e.g. TFTs) of the pixels without using an additional, separate forming process.

A portion of the BM 113 of the upper substrate 110 that corresponds to the first light sensor 200 is removed in order to allow the first light sensor 200 to receive external light. In addition, the gate electrode 227 of the first sensor 200 blocks light from reaching the first semiconductor layer 221 of the first sensor 200 from a backlight unit located at a rear surface of the lower substrate 130. The gate electrode may be formed from the gate line GL1.

Figure 4A:
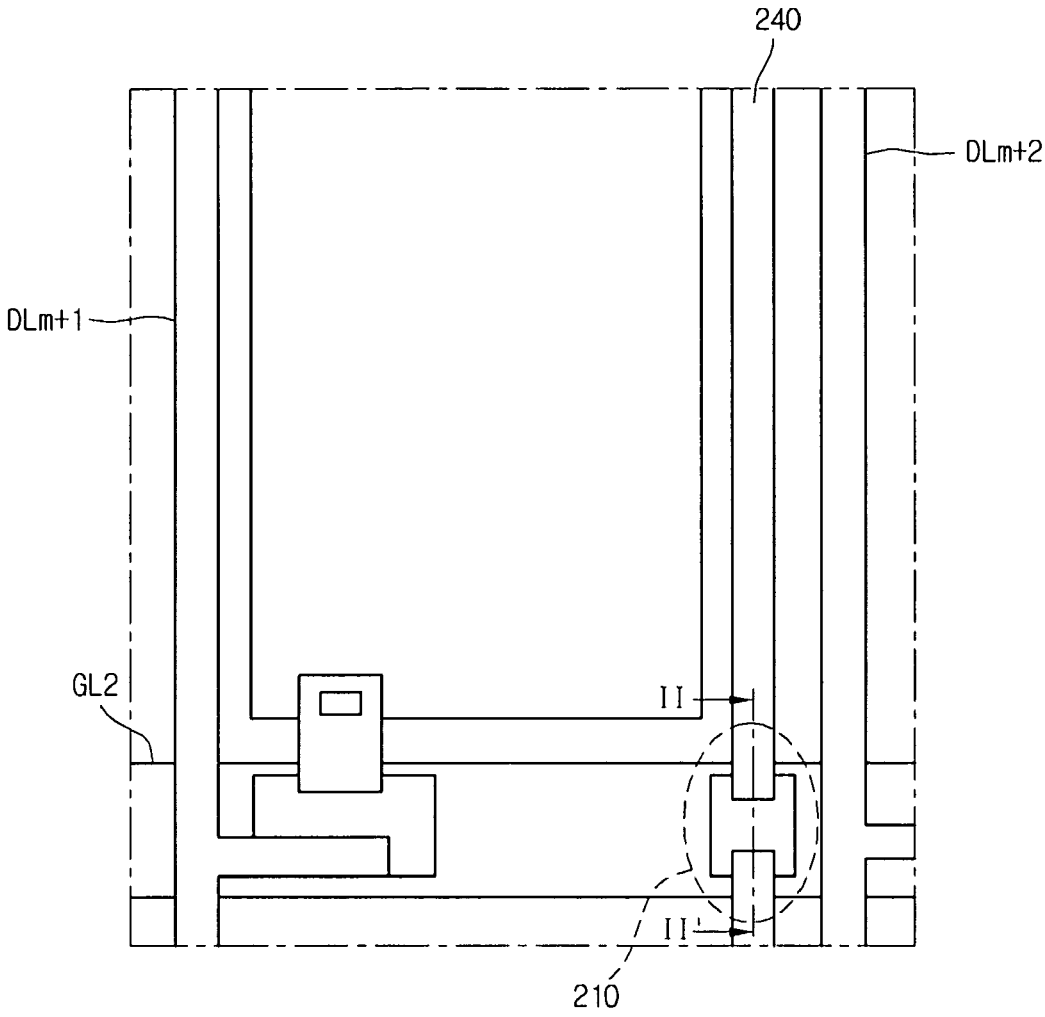
FIG. 4A is a detailed view illustrating a portion D of FIG. 2.
Figure 4B:
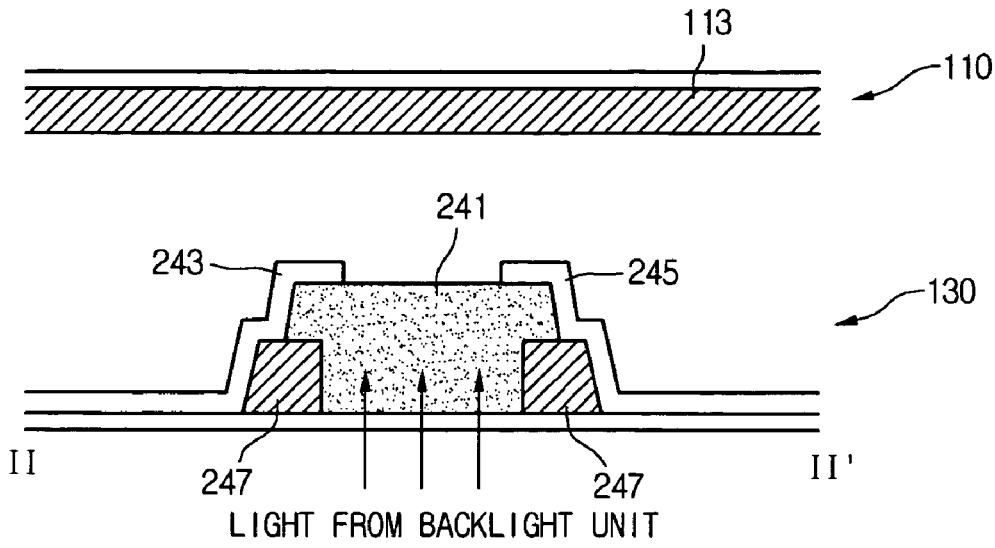
FIG. 4B is a cross-sectional view taken along a line II-II' of FIG. 4A.

FIG. 4A is a detailed view illustrating a portion D of FIG. 2 and FIG. 4B is a cross-sectional view taken along a line II-II' of FIG. 4A.

Referring to FIGS. 4A and 4B, the second sensor 210 is formed in a portion where the gate line GL2 and the second sensor line 240 spaced a predetermined distance from and formed in parallel to the data line DLm+2 of the lower substrate 130 cross.

The second light sensor 210 includes a second gate electrode 247, a second semiconductor layer 241, and second source and drain electrodes 243 and 245. The first light sensor 210 may be able to be formed on the gate line GL2. The second gate electrode 247 is the gate line GL2 at this time.

The second light sensor 210 may be formed simultaneously with the forming of the switching devices (e.g. TFTs) of the pixels are formed without using an additional, separate forming process.

The BM 113 for blocking external light is formed on a portion of the upper substrate 110 that corresponds to the first light sensor 200.

A portion of the second gate electrode 247 of the second light sensor 210 that corresponds to the second semiconductor is removed to allow the second light sensor 210 to receive light from the backlight unit 150. The gate electrode may be formed of a portion of a gate line GL1. The BM 113 includes a portion formed over the second light sensor 210 that blocks ambient light from reaching the second light sensor 210 during operation.

The backlight unit 150 includes a light source for emitting light and optical sheets disposed on the light source to diffuse and condense the light.

The first and second semiconductor layers 221 and 241 may be formed of amorphous silicon having an energy band structure sensitive to light energy.

Figure 5A:
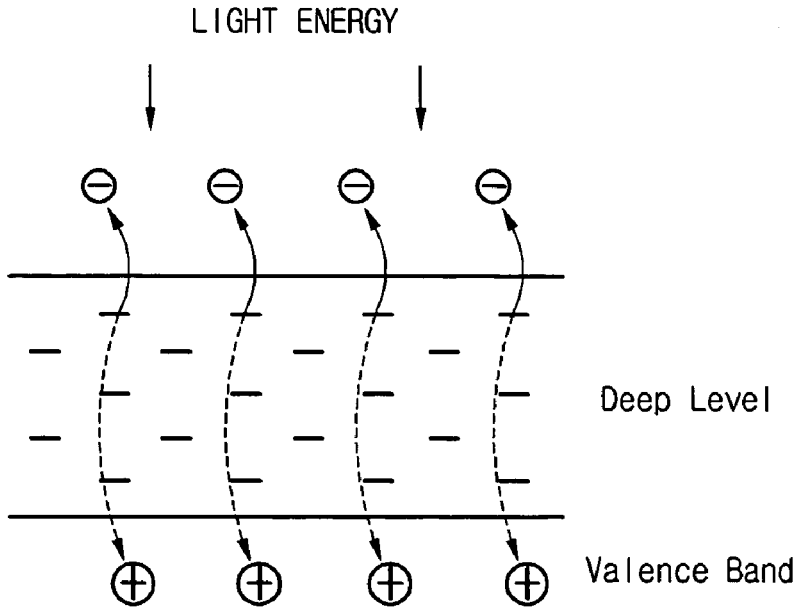
FIGS. 5A to 5C are views illustrating an energy band structure of a semiconductor layer according to the present invention.
Figure 5B:
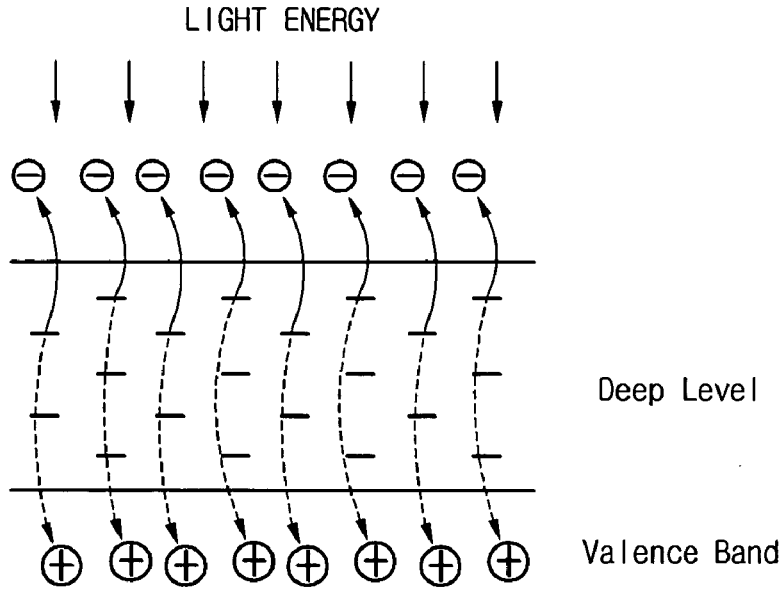
Figure 5C:
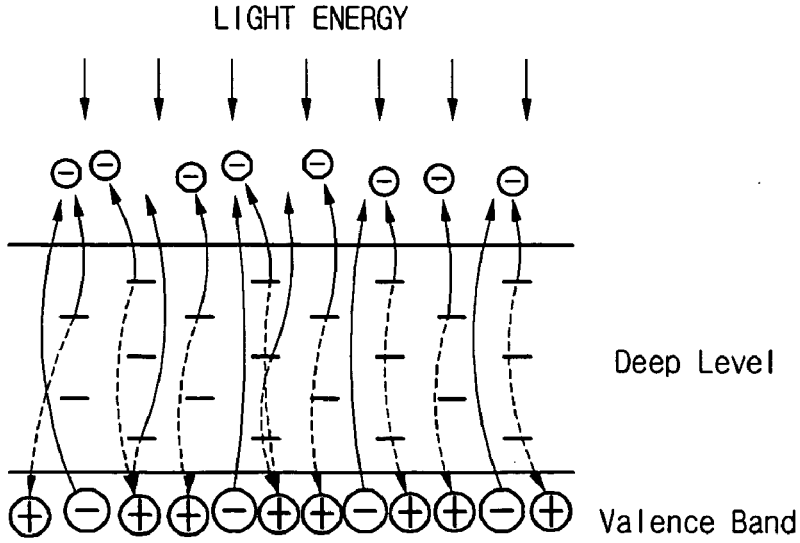

FIGS. 5A to 5C are views illustrating an energy band structure of a semiconductor layer according to the present invention.

As illustrated in Referring to FIGS. 5A to 5C, energy band structures of the first and second semiconductor layers 221 and 241 of FIGS. 3B and 4B have a band gap located between a conduction band and a valence band. When light having energy greater than the band gap is incident on a semiconductor layer 221 or 241, electrons are excited from the valence band to the conduction band. When an electric field is applied to a semiconductor having electrons excited into the conduction band, the electrons move in the direction of the electric field direction resulting in a current flow.

The first and second semiconductor layers 221 and 241 (FIGS. 3B and 4B) are formed of amorphous silicon having a large number of deep levels caused by impurities between band gaps making the first and second semiconductor layers 221 and 241 very sensitive to light energy.

Referring to FIG. 5A, when light energy is illuminated onto amorphous silicon, electrons in the deep level located closely to the conduction band are excited. As the intensity of light energy is increased, electrons in the deep levels in the band gap move to the conduction band and the intensity of the current increases as illustrated in FIG. 5B. When intensity of light energy is increased even more and light having energy of more than the band gap is illuminated, electrons located in the valence band are excited into the conduction band, and the intensity of the current increases in proportion to intensity of light energy as illustrated in FIG. 5C.

Referring to FIGS. 3B and 4B, the first and second light sensors 200 and 210 use characteristics of the above-described semiconductor. When intensity of light energy is strong, intensity of a current flowing through the first and second source and drain electrodes 223, 225, 243, and 245 is strengthened. On the other hand, when intensity of light energy is weak, intensity of the current flowing through the first and second source and drain electrodes 223, 225, 243, and 245 is weakened. Therefore, the first and second light sensors 200 and 210 compare external light or light from the backlight unit 150 depending on the intensity of a current flowing through the first and second source and drain electrodes 223, 225, 243, and 245 to control the backlight unit 150.

The transflective LCD device includes the plurality of first light sensors 200 sensing the external light (light external to the LCD device) and the plurality of second light sensors 210 sensing the light from the backlight unit 150 when forming switching devices (e.g., TFTs) of the display region of the lower substrate 130 to automatically control the external light and the backlight unit 150. Because the backlight unit 150 is automatically controlled to switch into one of the reflection mode and the transmission mode, a user does not have to manipulate the mode of the transflective LCD device and power consumption can be reduced without deterioration of the display quality.

As descried above, in an embodiment according to the present invention, the plurality of first light sensors for sensing external light and the plurality of second light sensors for sensing light from the backlight unit are provided on one side of the lower substrate of the LC display panel, so that the intensity of external light is compared with the intensity of light from the backlight unit to allow power consumption to be reduced while reducing or eliminating deterioration of display quality.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a liquid crystal display panel including a first substrate having a display region and a non-display region, a liquid crystal layer, and a second substrate;

a backlight unit opposite a surface of the first substrate that illuminates light onto the liquid crystal display panel;

a plurality of gate lines arranged to cross a plurality of data lines on the first substrate;

a switching device formed in intersection portions of the gate lines and the data lines, wherein the switching device is driven by a signal applied through the gate line;

a plurality of first and second sensor lines substantially parallel to the data lines;

a plurality of first sensors at crossings of the gate lines and the first sensor lines in a first region of the display region of the first substrate to sense ambient light; and a plurality of second sensors at crossings of the gate lines and the second sensor lines in a second region of the display region of the first substrate to sense light from the backlight unit, wherein the first sensors and the second sensors are formed on the gate line that is connected to the switching device, and wherein a black matrix blocking light is formed on the second substrate to exclude a portion of the second substrate that corresponds to the first sensors to allow ambient light to be incident on the first sensors, wherein each of the first and second sensors includes a gate electrode, a semiconductor layer formed on the gate electrode wherein a current flow amount changes according to intensity of light illuminated thereon and source and drain electrodes formed on the semiconductor layer, wherein a portion of a gate electrode of the second sensor includes an opening to expose the second sensor to light from the backlight unit, and wherein the semiconductor layer of the second sensor directly contacts the first substrate and the gate electrode in the opening.

2. The liquid crystal display device according to claim 1, further comprising:

a comparing unit that generates a comparison result based on a comparison of an output signal of the first sensor and an output signal of the second sensor; and a control unit that controls the backlight unit according to the comparison result.

3. The liquid crystal display device according to claim 2, wherein the control unit suspends an operation of the backlight unit when the output signal of the first sensor is greater than the output signal of the second sensor.

4. The liquid crystal display device according to claim 2, wherein the control unit operates the backlight unit when the output signal of the first sensor is smaller than the output signal of the second sensor.

5. The liquid crystal display device according to claim 2, further comprising a first sensor output line that connects the first sensor lines to the comparing unit.

6. The liquid crystal display device according to claim 2, further comprising a second sensor output line that connects the second sensor lines to the comparing unit.

7. The liquid crystal display device according to claim 1, wherein each first sensor includes a gate electrode that blocks light emitted by the backlight unit from being incident on the first sensor.

8. The liquid crystal display device according to claim 1, further including a black matrix portion corresponding to each of the second sensors that blocks ambient light from falling incident on the second sensors.

9. A method for driving a liquid crystal display device including a liquid crystal display panel including: a first substrate having a display region and a non-display region, and a second substrate; a backlight unit opposite a surface of the first substrate that illuminates light; a plurality of gate lines and data lines arranged to intersect on the first substrate; a switching device formed in intersection portions where the gate lines and the data lines, wherein the switching device is driven by a signal applied through the gate line; a plurality of first and second sensor lines arranged in parallel to the data lines; a plurality of first sensors on crossings of the gate lines and the first sensor lines in a first region of the first substrate; a plurality of second sensors on crossings of the gate lines and the second sensor lines in a second region of the first substrate; a comparing unit connected to the first and second sensor lines; and a control unit connected between the comparing unit and the backlight unit comprising:

sensing ambient light using the first sensors at the crossings of the gate lines and the first sensor lines in the first region of the display region of the first substrate;

sensing light from the backlight unit using the second sensors at the crossings of the gate lines and the second sensor lines in the second region of the display region of the first substrate; and comparing an intensity of ambient light with an intensity of light from the backlight unit to control the backlight unit, wherein the first sensors and the second sensors are formed on the gate line that is connected to the switching device, and wherein a black matrix blocking light is formed on the second substrate to exclude a portion of the second substrate that corresponds to the first sensors to allow ambient light external to the liquid crystal display device to be incident on the first sensors, wherein each of the first and second sensors includes a gate electrode, a semiconductor layer formed on the gate electrode and whose current amount changes according to intensity of light illuminated thereon, and source and drain electrodes formed on the semiconductor layer, and wherein the gate electrode of each second sensor includes an opening that exposes the second sensor to light from the backlight unit, and wherein the semiconductor layer of the second sensor directly contacts the first substrate and the gate electrode in the opening.

10. The method according to claim 9, further comprising:

providing a first signal corresponding to the sensed ambient light via the first sensor line to the comparing unit;

providing a second signal corresponding to the sensed light from the backlight unit via the second sensor line to the comparing unit;

generating a comparison result by comparing the first signal and the second signal using the comparing unit; and controlling the backlight unit according to the comparison result using the control unit.

11. The method according to claim 10, wherein controlling the backlight unit according to the comparison result using the control unit includes suspending an operation of the backlight unit when the output of the first sensor is greater than the output of the second sensor.

12. The method according to claim 10, wherein controlling the backlight unit according to the comparison results using the control unit includes maintaining an operation of the backlight unit when the output of the first sensor is smaller than the output of the second sensor.

13. The method according to claim 9, wherein the gate electrode of each first sensor blocks light emitted by the backlight unit from being incident on the respective first sensor.

14. The method according to claim 9, wherein a black matrix that blocks light is formed on the second substrate having a portion corresponding to the second sensors to prevent ambient light external to the liquid crystal display device from falling incident on the second sensors.

* * * * *